US007000714B2

(12) United States Patent
Gessay et al.

(10) Patent No.: US 7,000,714 B2
(45) Date of Patent: Feb. 21, 2006

(54) HEAD FOR INJECTING A FLUID UNDER PRESSURE TO BREAK UP GROUND FROM A BOREHOLE

(75) Inventors: Jean-Claude Gessay, Nanterre (FR); Jacques Morey, Nanterre (FR); Fabrice Mathieu, Nanterre (FR)

(73) Assignee: Compagnie du Sol, Nanterre (FR)

( * ) Notice: Subject to any disclaimer, the term of this patent is extended or adjusted under 35 U.S.C. 154(b) by 133 days.

(21) Appl. No.: 10/639,188

(22) Filed: Aug. 11, 2003

(65) Prior Publication Data

US 2005/0077041 A1 Apr. 14, 2005

(30) Foreign Application Priority Data

Aug. 13, 2002 (FR) ..... 02 10251

(51) Int. Cl.
*E21B 7/26* (2006.01)

(52) U.S. Cl. ..... 175/424; 175/67

(58) Field of Classification Search ..... 175/21–23, 175/65, 67, 72, 424
See application file for complete search history.

(56) References Cited

U.S. PATENT DOCUMENTS 4,534,427 A * 8/1985 Wang et al. ..... 175/67
4,930,586 A * 6/1990 Turin et al. ..... 175/25
5,228,809 A 7/1993 Yoshida et al.
5,787,998 A * 8/1998 O'Hanlon et al. ..... 175/67

FOREIGN PATENT DOCUMENTS

DE 299 16 060 U1 4/2000

OTHER PUBLICATIONS

Patent Abstracts of Japan vol. 10, No. 216, & JP 61 053912. Method of Improving Ground by Building Columnar Curing Wall. Mar. 18, 1986.

* cited by examiner

*Primary Examiner*—Frank S. Tsay
(74) *Attorney, Agent, or Firm*—Merchant & Gould P.C.

(57) ABSTRACT

The present invention provides a head for injecting a fluid under pressure for breaking up the ground from a borehole and mounted at the end of a string of rods. The body of the drilling head has a bottom wall for mounting a mechanical drilling tool having a feed pipe, at least one injection nozzle, and duct-forming means for connecting the feed pipe with liquid at the inlet of said nozzle, the duct-forming means presenting a mean line having a radius of curvature that varies continuously, the right section of said duct-forming means decreasing regularly over at least half its length from its first end towards its second end. The injection head further comprises at least one pipe for feeding said mechanical tool, said pipe being connected at a first end to said duct-forming means and at a second end to a chamber disposed at the bottom end of said injection head and fitted with a controllable shutter member interposed between said chamber and the pipe for feeding said mechanical tool.

8 Claims, 3 Drawing Sheets

FIG.4
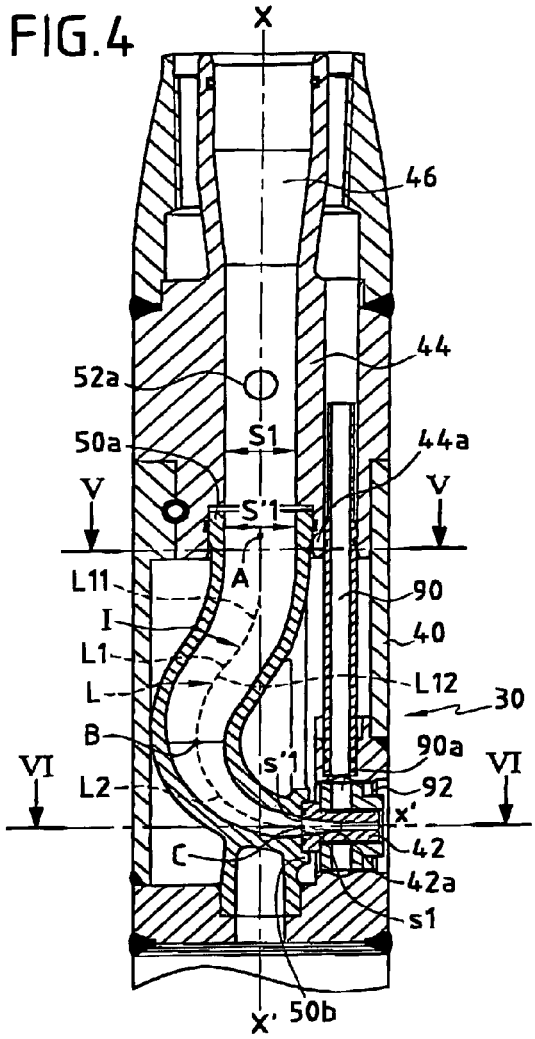
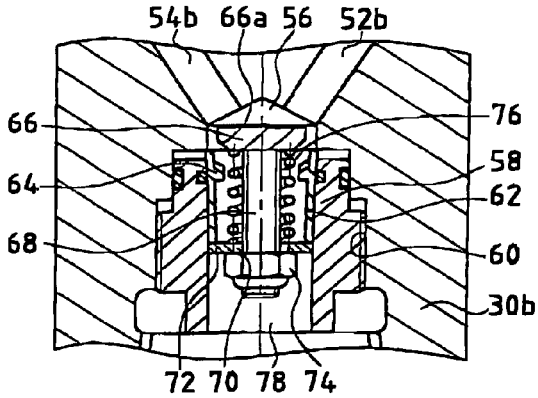
FIG.8
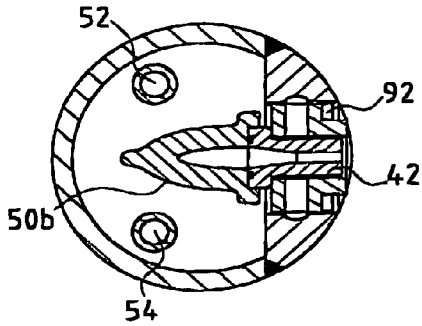
FIG.6
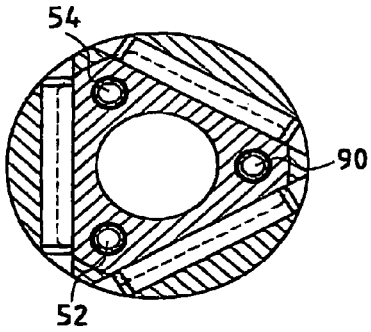
FIG.5
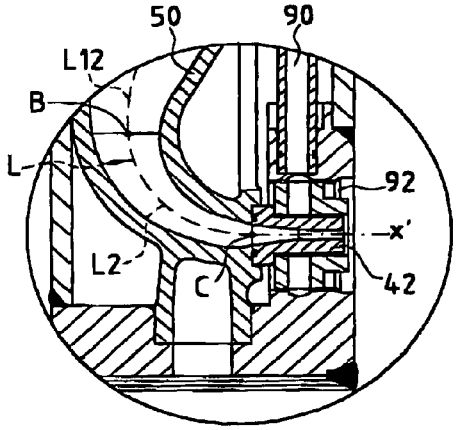
FIG.7

HEAD FOR INJECTING A FLUID UNDER PRESSURE TO BREAK UP GROUND FROM A BOREHOLE

The present invention relates to a head for injecting a fluid under pressure, usually a liquid, which head may be fitted to a boring tool for boring an excavation in the soil, and the invention relates in particular to an injection head for implementing the technique known as "jet grouting".

BACKGROUND OF THE INVENTION

The jet grouting technique consists in breaking up the ground by means of a jet of fluid having very high kinetic energy that is delivered in a borehole, the jet of fluid eroding the soil in which it is desired to make an excavation. To form the jet, a nozzle is used which is fixed to the end of drilling rods, these rods serving both to convey the fluid under high pressure to the nozzle(s) and to move the nozzle progressively into the ground. More precisely, the nozzle(s) is/are mounted on a member usually referred to as a "monitor" or an "injection head" which is fixed to the bottom end of the drill string, said monitor itself possibly being fitted at its own bottom end with a mechanical drilling tool. As is known, the fluid that is usually used is a cement-based grout which makes it possible, after boring, to make a foundation element of cement that is molded in place in the ground. It is also possible to have a plurality of jets of fluid, one of which may be a gas such as air.

In the description below, mention is made of liquid, but it should be understood that in special cases, the fluid could be constituted at least in part by a gas.

The liquid is conveyed by the rods and it is delivered from the surface by a pump at pressures lying in the range one to several tens of megapascals (MPa). The inside diameter of the rods conveying the liquid needs to be large enough to limit head losses in the rods. This diameter may typically be of the order of 20 millimeters (mm) to 50 mm. In contrast, the nozzle outlet diameter needs to be small enough to impart sufficient speed to the outgoing liquid jet to enable it to erode the ground remotely. Typically, the outlet diameter of the nozzle lies as a general rule in the range 2 mm to 5 mm, and the outlet speed of the liquid from the nozzle is one to several hundreds of meters per second (m/s).

In order to obtain a high quality jet, it is desirable for the inside shape of the nozzle to be optimized in order to conserve as high a speed as possible for the liquid jet as the jet departs from the nozzle going towards the ground so as to enable it to erode the ground as much as possible while using a minimum amount of kinetic energy. Optimized nozzle shapes that satisfy this requirement are in widespread use.

However, even with such nozzles, it is found that the jet quickly loses effectiveness in terms of its ability to erode the ground, such that considerable amounts of kinetic energy are required, so that when the rods are moved in translation, and possibly also in rotation, the ground is eroded at a considerable distance from the nozzle, for example at a distance of several decimeters (dm). The active radius of the jet of liquid under pressure for forming a column, a column sector, or a flat element generally remains mediocre, lying in the range a few decimeters to 1 or 2 meters (m) depending on the method implemented, the nature of the ground, and the energy used.

In order to increase the effectiveness of the jet, proposals have been made, in particular in U.S. Pat. No. 5,228,809, for an embodiment of the injection head or monitor that enables the quality of the jet to be improved.

Accompanying FIG. 1 shows the injection head described in that patent. The injection head 10 comprises a body 12 having a side wall 14 defining an internal cavity. A nozzle 16 for injecting liquid under pressure is mounted in the outside wall 14 of the monitor. In this figure, there can also be seen elements 18 for coupling to the string of rods and elements 20 and 22 for coupling to the pressurized liquid pipe and to an annular air pipe extending along the rods in order to feed simultaneously the nozzle with liquid and an annular nozzle with air. According to that patent, the nozzle 16 is fed from the pressurized liquid pipe 22 by a passage 24 made in the monitor body, and by a tube 26 connecting the end of said passage to the inlet of the nozzle 16. The tube 26 is of constant section and of regular curvature so as to limit disturbance to the pressurized liquid between the drilling rod and the nozzle 16 itself. Nevertheless, as explained, the diameter of the injection nozzle is very small compared with the diameter of the pipe used for conveying the pressurized liquid along the rods. The technique described in that above-mentioned United States patent is therefore not completely satisfactory, in particular because of said differences in section. Furthermore, it can be seen that the passage 24 forms right angles relative to the pipe 22 and the pipe 26. Such a disposition leads to significant disturbances in the flow of liquid at the inlet to the tube 26, and thus in the nozzle.

In addition, the monitor described in that patent does not enable the mechanical tool that might be mounted on the monitor to be fed with liquid under pressure.

Unfortunately, it is necessary to feed the mechanical tool with drilling liquid in order to lubricate it, and above all in order to raise the cuttings that result from the drilling.

It is therefore advantageous to be capable of having a single monitor suitable both for feeding jet grouting nozzles under good conditions and also for feeding the drilling tool at the bottom of the monitor. In order to obtain optimum feed to the injection nozzle, it is necessary in some cases to be able to interrupt the feed to the drilling tool so that the entire flow of fluid, e.g. a grout under high pressure, is used for feeding the injection nozzle.

OBJECTS AND SUMMARY OF THE INVENTION

An object of the present invention is to provide an injection head, in particular for implementing jet grouting, which serves to improve more significantly the quality of the jet supplied by the nozzle(s) of the injection head mounted at the bottom end of the drill string, while also making it possible with the same injection head to feed the mechanical drilling tool.

According to the invention, this object is achieved by a head for injecting a fluid under pressure to break up ground from a borehole, said head being mounted at the end of a string of rods or tubes, said string including a pipe disposed coaxially with said string of rods for feeding fluid under pressure, said head comprising a body having a top end for connection to the bottom end of the string of rods or tubes, a bottom wall for mounting a mechanical drilling tool including a feed pipe, and an outer wall, the body having at least one injection nozzle mounted therein with an inlet diameter equal to d and presenting an axis xx', and duct-forming means for connecting the liquid feed pipe to the inlet of said nozzle, wherein said duct-forming means present a mean line having a first end connected to the bottom end of the liquid feed pipe and having a second end connected tangentially to the axis xx' of the nozzle, said mean line being defined by at least one curved portion presenting a radius of curvature that varies continuously, the right section of said duct-forming means decreasing regularly over at least half of its length from its first end to its second end. It further comprises:

at least one feed channel for feeding said mechanical tool with fluid under pressure, said channel being connected firstly to the first end of the duct-forming means and secondly to a chamber disposed at the bottom end of said injection head; and a controllable valve interposed between said chamber and the pipe for feeding said mechanical tool.

It will be understood that the quality and the direction of the jet produced by the nozzle are significantly improved because of the progressive and regular reduction in the right section of the duct-forming means, for example a tube, over at least half of its length from its end for connection to the fluid feed pipe, usually liquid under pressure, to its end for connection to the inlet orifice of the injection nozzle. This characteristic combined with the fact that the mean line of the duct-forming means presents a radius of curvature that varies regularly, makes it possible to minimize the disturbance to the flow of liquid in said tube and thus to obtain a jet with maximum energy and of erosive power that is maintained at a maximum distance away from the nozzle in the ground.

In addition, the monitor makes it possible selectively to feed the nozzle(s) or to feed both the nozzle(s) and the mechanical drilling tool. It is thus possible to perform two types of operation without changing the tool that is fixed to the end of the drill string This option makes it possible to shorten the time required for drilling very significantly.

In a preferred embodiment, said duct-forming means comprise a first fraction that is substantially rectilinear extending along the longitudinal axis of said injection head and extending the feed pipe of the string of rods, a second fraction having a mean line that presents a point of inflection, and a third fraction whose mean line presents curvature of constant sign.

BRIEF DESCRIPTION OF THE DRAWINGS

Other characteristics and advantages of the invention appear better on reading the following description of various embodiments of the invention given as non-limiting examples. The description refers to the accompanying figures, in which;

FIG. 4 is a fragmentary vertical section view on line IV—IV of FIG. 3;

FIG. 5 is a horizontal section view on line V—V of FIG. 4;

FIG. 6 is a horizontal section view on line VI—VI Of FIG. 4;

FIG. 7 is a detail view of FIG. 4 showing how the injection nozzle is implanted; and FIG. 8 is a fragmentary view of FIG. 3 showing a preferred embodiment of the valve for feeding the mechanical drilling tool.

MORE DETAILED DESCRIPTION

Figure 1:
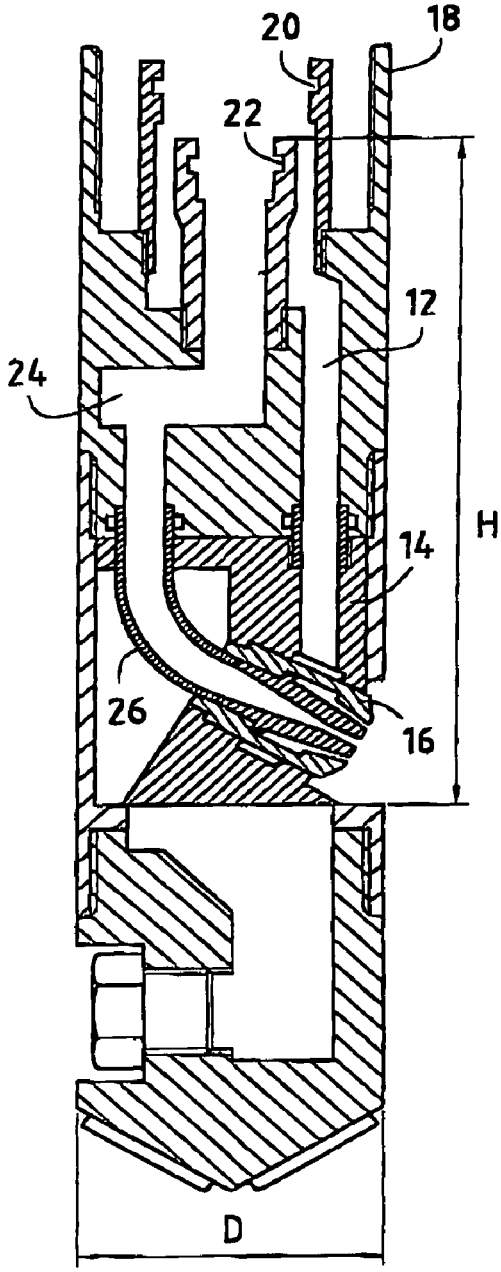
FIG.1 PRIOR ART
FIG. 1, described above, is a vertical section view through a prior art injection head.
Figure 2:
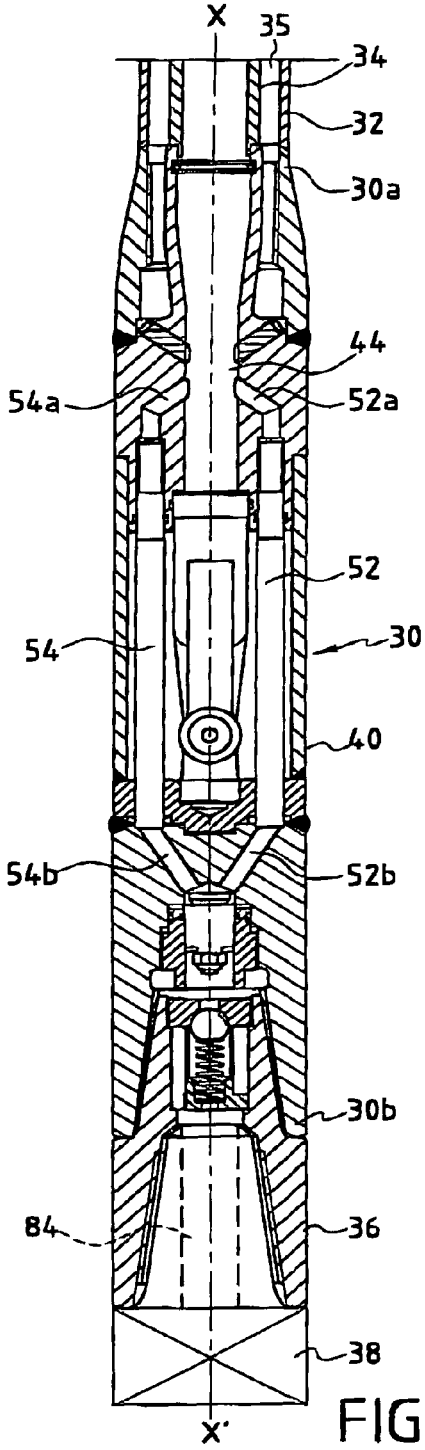
FIG. 2 is a vertical section view through a drilling tool assembly of the invention shown mounted at the bottom end of a drill string.

The drilling tool is described initially with reference to FIG. 2. The tool is essentially constituted by an injection head or monitor 30 which, as explained in greater detail below, serves to deliver a jet of liquid under pressure, or more generally a jet of fluid under pressure, which is delivered via a nozzle to break up the wall of a borehole. The liquid under pressure is typically a grout or an analogous filled liquid. The top end 30*a* of the monitor 30 is connected to drill strings such as 32 in order to lower the tool and set it in rotation. The string of drill rods 32 is preferably fitted with an inner coaxial pipe 34 serving to convey the liquid under pressure for feeding the injection nozzle and the mechanical drilling tool. At the bottom end 30*b* of the monitor 30 there is mounted an intermediate part 36, itself serving for mounting the mechanical drilling tool 38 or bottom tool.

The injection head 30 comprises a body having an outer wall 40 of generally cylindrical shape. An injection nozzle 42, or possibly a plurality of injection nozzles, is/are mounted close to the bottom end 30*b* of the monitor. The nozzle 42 is connected to the feed pipe 34 of the drill rod 32 via a first channel 44 connected to the pipe 34 by a converging portion 46. The channel 44 has a section S1 which is very slightly smaller than the section of the pipe 34 in the drill rods. The channel 44 extends substantially along the longitudinal axis XX' of the monitor 30, i.e. in line with the pipe 34. A pipe 50 of shape that is described in greater detail below serves to connect the nozzle 42 to the rectilinear channel portion 44. The first end 50*a* of the pipe 50 is connected to the bottom end 44*a* of the channel 44 while its second end 50*b* is connected to the inlet 42*a* of the nozzle 42. In the preferred embodiment described, the injection nozzle 42 has an axis xx' which is substantially horizontal.

At its first end 50*a*, the pipe 50 has a section S'1 equal to the section S1 of the channel 44, and at its second end 50*b*, it has a section s'1 equal to the inlet section s1 of the nozzle 42. The pipe 50 presents a mean line L and the sections of the pipe 50 that extend orthogonally to the mean line L may be circles, ellipses, or oval shapes. According to an essential characteristic of the invention, the right section of the pipe 50 decreases regularly from its maximum value S'1 to its minimum value s'1.

In addition, the mean line L of the pipe 50 presents a special shape so as to obtain flow lines all the way to the nozzle 42 that are as regular as possible. The mean line L has a first portion L1 extending from the top end A to an intermediate point B having a vertical tangent, and a second portion L2 extending from the point B to the second end C for connection with the injection nozzle 42. At its end A, the mean line L1 connects tangentially with the axis XX' of the channel 44. A fraction of mean line L1 presents a first portion L11 with a regular radius of curvature of constant sign and a second portion L12 presenting a regular radius of curvature of constant sign that is the opposite of the portion L11. These two portions of the mean line L are naturally interconnected via a point of inflection I. A second fraction L2 of mean line L of the pipe 50 presents a radius of curvature that varies regularly while retaining the same sign all the way from point B to its end C.

As a result of the special shape given to the pipe 50, it presents a right section which decreases regularly from its end A to its end C, and its mean line presents a succession of radii of curvature that are likewise regular all the way from its end C to its end A. It will be understood that the combination of these two characteristics makes it possible to define regular flow lines between the channel 44 and the inlet 42*a* of the nozzle 42 for the liquid under pressure flowing along the pipe 50. This regular flow makes it possible to obtain a jet of liquid under pressure at the outlet from the nozzle 42 that is of optimum shape and thus presents maximum ability for drilling into the wall of the borehole.

It should also be emphasized that because of the special shape of the pipe 50, it is possible to connect the axial channel 44 to the nozzle 42 via a pipe whose radius of curvature varies regularly.

Finally, because of this shape for the pipe 50, the or each nozzle 42 can have an axis xx' lying in a plane orthogonal to the longitudinal axis XX' of the monitor, i.e. can have a horizontal axis. The jet produced by the nozzle thus lies in a plane that is orthogonal to the wall that is to be drilled.

There follows a description of the portion of the monitor that is used for feeding the mechanical drilling tool 38 with liquid under pressure. In the preferred embodiment described, this feed is provided by two pipes 52 and 54 extending parallel to the axis XX' of the monitor, each having a respective first or top end 52*a*, 54*a* opening out into the rectilinear channel 44 for feeding liquid under pressure, and each having a bottom end 54*b* or 52*b* opening out into an internal chamber 56 that can be seen more clearly in FIG. 8 and that lies on the axis XX' of the injection head. The internal chamber 56 is fitted with a valve 58 mounted in a housing 60 provided at the bottom end of the monitor body 30.

The valve 58 comprises a cylindrical body 62 mounted in leaktight manner in the housing 60, thereby extending the chamber 56. The wall 62 of the valve defines a valve seat 64 suitable for co-operating with a moving shutter member 66. The shutter member 66 is fixed to the end of a valve rod 68 slidably mounted in an axial hole 70 in the bottom wall 72 of the valve body. A nut 74 is screwed onto the outside end of the rod 68, and constitutes an outside shoulder therefor This shoulder defines a rest position for the shutter member 66. The shutter member 66 is held in this rest position as shown in FIG. 8 by a return spring 76 interposed between the shutter member 66 and the bottom end 72 of the valve body.

The shutter member 66 has a top face 66*a* placed in the chamber 58 and which is therefore subjected to the pressure of the liquid under pressure that arrives via the pipes 52 and 54. When the pressure of the liquid in the chamber 66 exceeds a predetermined value, the flow of liquid establishes suction beneath the shutter member 66. The action of this pressure on the top face 66*a* co-operating with the suction that is created causes the return spring 76 to become compressed and the shutter member 66 moves downwards until it comes into contact with the valve seat 64. In this position, the flow of liquid under pressure from the pipes 52 and 54 to the axial outlet 78 of the valve.

Figure 3:
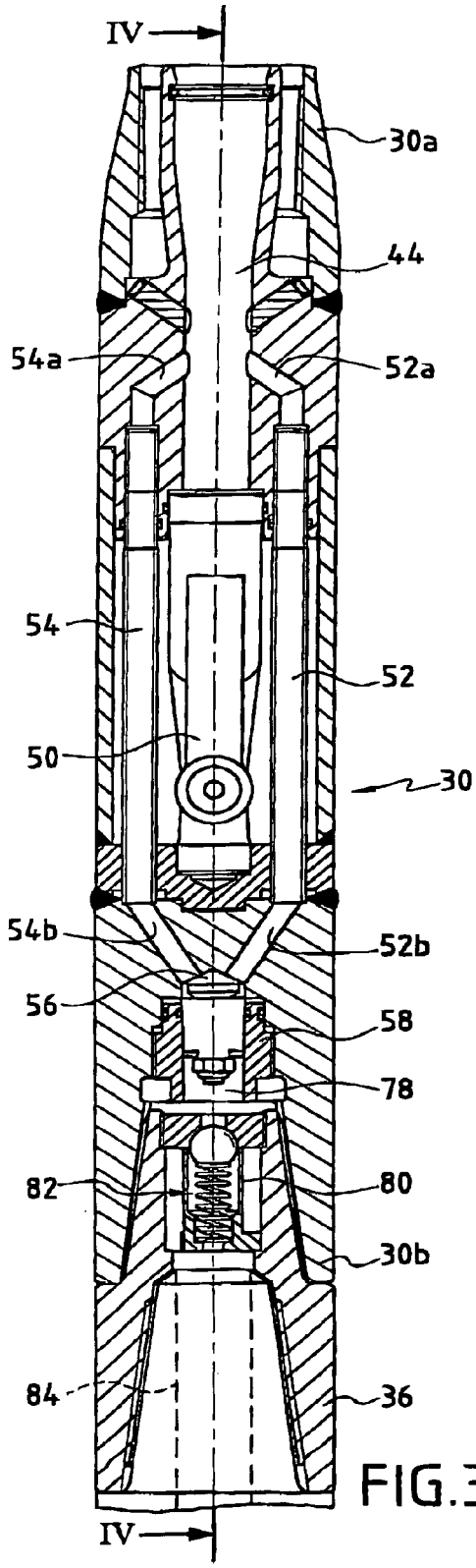
FIG. 3 is a vertical section view of the injection head.

As shown more clearly in FIG. 3, the outlet 78 from the valve 78 is extended by an axial bore 80 formed in the intermediate part 36. The bore 80 is fitted with a check valve 82. Finally, the bore 80 in the intermediate part 36 is extended beyond the check valve 82 by the axial duct 84 for feeding the mechanical drilling tool 38. The check valve 82 serves merely to prevent drilling liquid from flowing back into the pipes inside the monitor.

The complete drilling tool operates as follows. During stages of use where it is desired merely to drill by means of the mechanical tool 38, the pressure of the drilling liquid flowing along the pipes 34, 44, 50, 52, 54, and 78 is relatively low As a result the jet of liquid under pressure delivered by the nozzle 42 is not very effective and the mechanical drilling tool 38 is fed via the open valve 58, as shown in FIG. 8. In contrast, when it is desired to proceed with a jet grouting step, i.e when it is desired to use the jet produced by the nozzle 42 to perform drilling, then the pressure of the liquid in the above-specified pipes is raised. As explained above, this pressure causes the shutter member 66 of the valve 58 to move downwards, thereby shutting off the feed to the mechanical drilling tool 36. Under such conditions, the entire flow of liquid arriving via the pipes 34 in the drilling rods is used for feeding the injection nozzle 42 which then operates at maximum effectiveness.

When the pressure of the liquid is lowered to beneath the predetermined value, the shutter member 66 lifts off its seat and the mechanical drilling tool is again fed with liquid.

In a variant, the monitor 30 may also have an auxiliary pipe 90 for feeding the jet-forming nozzle 42. This pipe 90 is fed directly from the annular space 35 that is present between the outer wall of the rod 32 and its inner pipe 34. The bottom end 90*a* of the pipe 90 serves to feed an annular space 92 surrounding the outlet of the nozzle 42. This auxiliary feed of fluid under pressure creates an annular jet surrounding the main jet produced by the nozzle 42 and serves to further improve the quality of the jet created by the nozzle 42.

It will be understood that by means of the monitor of the invention, the injection nozzle(s) 42 can be fed with liquid under pressure under good conditions, thereby also making it possible to obtain a pressurized jet of good effectiveness due to the regularity of the liquid streams in the pipe 50. The monitor 30 also serves to feed the mechanical bottom tool 38 with liquid under pressure without spoiling the quality of the jet produced by the nozzle 42. In addition, because of the presence of the valve 58, all of the liquid under pressure can be used for making the jet, should that appear to be necessary.

What is claimed is:

1. A head for injecting a fluid under pressure to break up ground from a borehole, wherein said head has a longitudinal axis and is mounted to a string of rods or tubes having a bottom end, said string including a first feed pipe having a bottom end and disposed coaxially with said string of rods for feeding fluid under pressure, said head comprising:

a body having a top end connected to the bottom end of the string of rods or tubes;

a bottom wall;

a mechanical drilling tooling mounted on said bottom wall and including a second feed pipe;

an outer wall connected to said bottom wall;

at least one injection nozzle mounted in said outer wall, said at least one injection nozzle having:

an inlet having a diameter; and an axis;

a duct located inside said outer wall and above said bottom wall, connecting said first feed pipe to the inlet of said at least one injection nozzle, said duct having:

a first end connected to the bottom end of said first feed pipe:

a second end connected tangentially to said axis of the at least one injection nozzle, wherein a cross-section said duct decreases regularly over at least half of its length from its first end to its second end;

at least one curved portion defining a mean line and presenting a radius of curvature that varies continuously, a chamber disposed at the bottom wall of said head;

at least one feed channel for feeding said mechanical tool with fluid under pressure, said at least one feed channel having a first end end a second end, wherein the first end of said at least one feed channel is connected to the first end of the duct, and wherein the second end of said at least one feed channel is connected to said chamber; and a controllable valve interposed between said chamber and said second feed pipe of said mechanical tool.

2. The injection head of claim 1, wherein said duct comprises:

a first portion, wherein said first portion is substantially rectilinear and extends along the longitudinal axis of said injection head and said first feed pipe of the string of rods, a second portion having a point of inflection, and a third portion having a constant curvature.

3. The injection head of claim 1, wherein the axis of said at least one injection nozzle lies in a plane orthogonal to the longitudinal axis of said injection head.

4. The injection head of claim 2, further including a second channel having a first end for feeding said mechanical tool, wherein the first end of said at least one channel and the first end of said second channel are connected to the first portion of said duct.

5. The injection head of claim 4, wherein said chamber is disposed on the longitudinal axis of said injection head.

6. The injection head of claim 1, wherein said controllable valve comprises a seat and a moving shutter member, wherein the position of said controllable valve is controlled by the flow of liquid flowing through said valve.

7. The injection head of claim 2, wherein the axis of said at least one injection nozzle lies in a plane orthogonal to the longitudinal axis of said injection head.

8. The injection head of claim 7, wherein said controllable valve comprises a seat and a moving shutter, wherein the position of said controllable valve is controlled by the flow of liquid flowing through said valve.

* * * * *